US007563182B2

(12) United States Patent
Shindo et al.

(10) Patent No.: US 7,563,182 B2
(45) Date of Patent: Jul. 21, 2009

(54) POLYMER COMPOSITION AND GOLF BALL MADE USING THE SAME

(75) Inventors: Jun Shindo, Chichibu (JP); Eiji Takehana, Chichibu (JP); Kae Yamazaki, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 11/878,945

(22) Filed: Jul. 27, 2007

(65) Prior Publication Data

US 2008/0032823 A1 Feb. 7, 2008

Related U.S. Application Data

(63) Continuation-in-part of application No. 11/324,297, filed on Jan. 4, 2006, now Pat. No. 7,294,067.

(30) Foreign Application Priority Data

Jul. 2, 2007 (JP) ..... 2007-174021

(51) Int. Cl.
*A63B 37/06* (2006.01)

(52) U.S. Cl. ..... 473/378

(58) Field of Classification Search ..... 473/378, 473/351

See application file for complete search history.

(56) References Cited

U.S. PATENT DOCUMENTS

| | | | | |
|---|---|---|---|---|
| 6,184,276 | B1 | 2/2001 | Ignatz-Hoover | |
| 6,194,505 | B1 | 2/2001 | Sone et al. | |
| 6,277,924 | B1 | 8/2001 | Hamada et al. | |
| 6,372,847 | B1 | 4/2002 | Wouters | |
| 6,596,801 | B2 | 7/2003 | Higuchi et al. | |
| 6,602,941 | B2 | 8/2003 | Higuchi et al. | |
| 6,634,961 | B2 | 10/2003 | Higuchi et al. | |
| 6,695,716 | B2 | 2/2004 | Higuchi et al. | |
| 6,712,715 | B2 | 3/2004 | Higuchi et al. | |
| 6,786,836 | B2 | 9/2004 | Higuchi et al. | |
| 6,786,839 | B2 * | 9/2004 | Hayashi et al. | 473/377 |
| 6,795,172 | B2 | 9/2004 | Putman et al. | |
| 6,818,705 | B2 | 11/2004 | Wu et al. | |
| 6,841,642 | B2 | 1/2005 | Kaszas | |
| 6,921,345 | B2 | 7/2005 | Higuchi et al. | |
| 6,923,735 | B1 | 8/2005 | Hayashi | |
| 2004/0147694 | A1 | 7/2004 | Sone et al. | |
| 2005/0148723 | A1 | 7/2005 | Kondou | |
| 2005/0215718 | A1 * | 9/2005 | Rajagopalan et al. | 525/221 |

FOREIGN PATENT DOCUMENTS

| | | | |
|---|---|---|---|
| JP | 7-268132 | A | 10/1995 |
| JP | 11-35633 | A | 2/1999 |
| JP | 2002-355336 | A | 12/2002 |
| JP | 2002-355337 | A | 12/2002 |
| JP | 2002-355338 | A | 12/2002 |
| JP | 2002-355339 | A | 12/2002 |
| JP | 2002-355340 | A | 12/2002 |
| JP | 2002-356581 | A | 12/2002 |
| JP | 2004-292667 | A | 10/2004 |
| WO | WO 03/082925 | | 10/2003 |

OTHER PUBLICATIONS

"Report of Research & Development", Fine Chemical, vol. 23, No. 9, p. 5-15 (1994).

"Hydrolysis of Tri-tert-butylaluminum" by Mason et al., J. American Chemical Society, vol. 115, pp. 4971-4984 (1993).

"Three-Coordinate Aluminum Is Not a Prerequisite for Catalytic Activity in the Zirconocene-Alumoxane Polymerization of Ethylene", by Harlen et al, J. American Chemical Society, vol. 117, pp. 6465-6474, (1995).

* cited by examiner

*Primary Examiner*—Raeann Trimiew
(74) *Attorney, Agent, or Firm*—Sughrue Mion, PLLC

(57) ABSTRACT

The present invention provides a polymer composition which includes (A) an olefin-unsaturated carboxylic acid random copolymer and/or an olefin-unsaturated carboxylic acid-unsaturated carboxylic acid ester random copolymer, (D) a metal ion neutralization product of an olefin-unsaturated carboxylic acid random copolymer and/or a metal ion neutralization product of an olefin-unsaturated carboxylic acid-unsaturated carboxylic acid ester random copolymer, or both components A and D, and also includes a specific amount of (B) a metal oxide which is capable of neutralizing acid groups in components A and/or D, and which is produced by plasma synthesis, laser synthesis or flame synthesis and has an average particle diameter of at most 200 nm. The invention also provides golf balls in which such a polymer composition serves as a component of the ball. The polymer composition is ionically bonded and has an excellent resilience. Golf balls made using the polymer composition have an outstanding rebound.

14 Claims, No Drawings

POLYMER COMPOSITION AND GOLF BALL MADE USING THE SAME

CROSS-REFERENCE TO RELATED APPLICATION

This application is a continuation-in-part of copending application Ser. No. 11/324,297 filed on Jan. 4, 2006 now U.S. Pat. No. 7,294,067, the entire contents of which are hereby incorporated by reference.

This application claims priority under 35 U.S.C. §119(a) on Patent Application No. 2007-174021 filed in Japan on Jul. 2, 2007, the entire contents of which are hereby incorporated by reference.

BACKGROUND OF THE INVENTION

The present invention relates to polymer compositions having excellent resilience which are particularly suitable as golf ball-forming materials, and to golf balls made using such polymer compositions.

Efforts to confer golf balls with an excellent rebound have until now focused on and optimized one or more indicator of the polybutadiene used as the base rubber, such as the Mooney viscosity, polymerization catalyst, solvent viscosity and molecular weight distribution. See, for example, Patent Document 1: JP-A 2004-292667; Patent Document 2: U.S. Pat. No. 6,818,705; Patent Document 3: JP-A 2002-355336; Patent Document 4: JP-A 2002-355337; Patent Document 5: JP-A 2002-355338; Patent Document 6: JP-A 2002-355339; Patent Document 7: JP-A 2002-355340; and Patent Document 8: JP-A 2002-356581.

For example, Patent Document 1 (JP-A 2004-292667) describes, as a base rubber for golf balls, a polybutadiene having a Mooney viscosity of from 30 to 42 and a molecular weight distribution (Mw/Mn) of from 2.5 to 3.8. Patent Document 2 (U.S. Pat. No. 6,818,705) describes, for the same purpose, a polybutadiene having a molecular weight of at least 200,000 and a resilience index of at least 40.

However, because many golfers desire golf balls capable of traveling a longer distance, there exists a need for the development of golf balls having an even better rebound.

Patent Document 9 (JP-B 39-6810) and Patent Document 10 (JP-B 53-41173) describe basic methods for preparing ionomers, although these methods have a number of associated problems, such as an unpleasant odor during neutralization and poor dispersion of white particles. The physical properties of the ionomers were subsequently improved, resulting in the disclosure of improved ionomers, such as those described in Patent Document 11 (JP-A 2002-514112), Patent Document 12 (JP-A 2003-512495) and Patent Document 13 (JP-A 2002-527597). However, from the standpoint of the ball rebound, even further improvements in the physical properties of the ionomer are desired.

Patent Document 1: JP-A 2004-292667
Patent Document 2: U.S. Pat. No. 6,818,705
Patent Document 3: JP-A 2002-355336
Patent Document 4: JP-A 2002-355337
Patent Document 5: JP-A 2002-355338
Patent Document 6: JP-A 2002-355339
Patent Document 7: JP-A 2002-355340
Patent Document 8: JP-A 2002-356581
Patent Document 9: JP-B 39-6810
Patent Document 10: JP-B 53-41173

Patent Document 11: JP-A 2002-514112
Patent Document 12: JP-A 2003-512495
Patent Document 13: JP-A 2002-527597

SUMMARY OF THE INVENTION

It is therefore an object of the invention to provide polymer compositions of excellent resilience which are suitable for use as golf ball materials, and golf balls made using such polymer compositions.

To attain the above objects, the invention provides the following polymer compositions and golf balls made therewith.

[1] A Polymer Composition Comprising:

(A) 100 parts by weight of an olefin-unsaturated carboxylic acid random copolymer and/or an olefin-unsaturated carboxylic acid-unsaturated carboxylic acid ester random copolymer, and (B) from 0.1 to 10 parts by weight of a metal oxide capable of neutralizing acid groups in component A; wherein the metal oxide is produced by plasma synthesis, laser synthesis or flame synthesis and has an average particle diameter of at most 200 nm.

[2] A Polymer Composition Comprising:

(D) 100 parts by weight of a metal ion neutralization product of an olefin-unsaturated carboxylic acid random copolymer and/or a metal ion neutralization product of an olefin-unsaturated carboxylic acid-unsaturated carboxylic acid ester random copolymer, and (B) from 0.1 to 10 parts by weight of a metal oxide capable of neutralizing acid groups in component D; wherein the metal oxide is produced by plasma synthesis, laser synthesis or flame synthesis and has an average particle diameter of at most 200 nm.

[3] A polymer Composition Comprising:

100 parts by weight of, in admixture, (A) an olefin-unsaturated carboxylic acid random copolymer and/or an olefin-unsaturated carboxylic acid-unsaturated carboxylic acid ester random copolymer and (D) a metal ion neutralization product of an olefin-unsaturated carboxylic acid random copolymer and/or a metal ion neutralization product of an olefin-unsaturated carboxylic acid-unsaturated carboxylic acid ester random copolymer, and (B) from 0.1 to 10 parts by weight of a metal oxide capable of neutralizing acid groups in components A and D; wherein the metal oxide is produced by plasma synthesis, laser synthesis or flame synthesis and has an average particle size of at most 200 nm.

[4] The polymer composition according to any one of [1] to [3] which further comprises, per 100 parts by weight of component A and/or component D, (C) from 5 to 80 parts by weight of a fatty acid having a molecular weight of at least 280 or a derivative thereof.

[5] The polymer composition of any one of [1] to [3], wherein the composition has a melt index of at least 1.0 dg/min.

[6] The polymer composition of any one of [1] to [3], wherein the metal oxide of component B is selected from the group consisting of zinc oxide, magnesium oxide, calcium oxide, titanium oxide, aluminum oxide, silicon oxide, selenium oxide, yttrium oxide, tin oxide, copper oxide, bismuth oxide, cobalt oxide, iron oxide, manganese oxide and holmium oxide.

[7] The polymer composition of any one of [1] to [3], wherein the metal oxide of component B has an average particle size of at most 100 nm.

[8] The polymer composition of any one of [1] to [3], wherein the metal oxide of component B is produced by a plasma synthesis process selected from the group consisting of arc plasma synthesis, plasma jet synthesis and high-frequency induction heating plasma synthesis.

[9] The polymer composition of [8], wherein the plasma synthesis process is arc plasma synthesis.

[10] The polymer composition of any one of [1] to [3], wherein the degree of neutralization is at least 50 mol %.

[11] A golf ball comprising a core and a cover of one or more layer, wherein the core or at least one layer of the cover is made of the polymer composition of any one of [1] to [10].

[12] A golf ball comprising a core and a cover of one or more layer, wherein the core is made of a material obtained by molding under heat a rubber composition which includes (a) a base rubber containing polybutadiene having a stress relaxation time ($T_{80}$), defined as the time in seconds from the moment when rotation is stopped immediately after measurement of the $ML_{1+4}$ (100° C.) value (the Mooney viscosity measured at 100° C. in accordance with ASTM D-1646-96) that is required for the $ML_{1+4}$ value to decrease 80%, of 3.5 or less, (b) an unsaturated carboxylic acid and/or a metal salt thereof, and (c) an organic peroxide; and at least one layer of the cover is made of the polymer composition of any one of [1] to [10].

DETAILED DESCRIPTION OF THE INVENTION

The invention is described more fully below.

The polymer composition of the invention includes (A) an olefin-unsaturated carboxylic acid random copolymer and/or an olefin-unsaturated carboxylic acid-unsaturated carboxylic acid ester random copolymer or (D) a metal ion neutralization product of an olefin-unsaturated carboxylic acid random copolymer and/or a metal ion neutralization product of an olefin-unsaturated carboxylic acid-unsaturated carboxylic acid ester random copolymer, or includes both components A and D.

Here, the olefin in component A is one having preferably at least 2 carbons, but preferably not more than 8 carbons, and more preferably not more than 6 carbons. Illustrative examples include ethylene, propylene, butene, pentene, hexene, heptene and octene. Ethylene is especially preferred.

Preferred examples of the unsaturated carboxylic acid include acrylic acid, methacrylic acid, maleic acid and fumaric acid. Acrylic acid and methacrylic acid are especially preferred.

The unsaturated carboxylic acid ester is preferably a lower alkyl ester of the above unsaturated carboxylic acid. Specific examples include methyl methacrylate, ethyl methacrylate, propyl methacrylate, butyl methacrylate, methyl acrylate, ethyl acrylate, propyl acrylate and butyl acrylate. Of these, butyl acrylate (n-butyl acrylate, i-butyl acrylate) is especially preferred.

The random copolymer of component A of the invention may be obtained by random copolymerization of the foregoing ingredients according to a known method. It is recommended that the content of unsaturated carboxylic acid (acid content) included in the random copolymer be preferably at least 2 wt %, more preferably at least 6 wt %, and even more preferably at least 8 wt %, but preferably not more than 25 wt %, more preferably not more than 20 wt %, and even more preferably not more than 15 wt %. If the acid content is too low, the resilience may decrease. On the other hand, if the acid content is too high, the processability may decrease.

The random copolymer neutralization product of component D of the invention may be obtained by neutralizing some of the acid groups on the random copolymer with metal ions. Illustrative examples of metal ions for neutralizing the acid groups include $Na^+$, $K^+$, $Li^+$, $Zn^{++}$, $Cu^{++}$, $Mg^{++}$, $Ca^{++}$, $Co^{++}$, $Ni^{++}$ and $Pb^{++}$. Of these, $Na^+$, $Li^+$, $Zn^{++}$ and $Mg^{++}$ are preferred, and $Zn^{++}$ is especially preferred. The degree to which the random copolymer is neutralized by these metal ions is not subject to any particular limitation. The neutralization product may be obtained by a known method, such as one that involves introducing to the random copolymer a suitable compound, examples of which include formates, acetates, nitrates, carbonates, bicarbonates, oxides, hydroxides and alkoxides of the above metal ions.

In the present invention, the random copolymer of component A or the neutralization product of component D may be used alone as the base resin, or both components A and D may be used together as the base resin. When both components are used together, the ratio therebetween is not subject to any particular limitation.

Illustrative examples of the random copolymer serving as component A of the invention include Nucrel AN4311, Nucrel AN4318 and Nucrel 1560 (all products of DuPont-Mitsui Polychemicals Co., Ltd.). Illustrative examples of the random copolymer neutralization product serving as component D of the invention include Himilan 1554, Himilan 1557, Himilan 1601, Himilan 1605, Himilan 1706, Himilan 1855, Himilan 1856 and Himilan AM7316 (all products of DuPont-Mitsui Polychemicals Co., Ltd.), and Surlyn 6320, Surlyn 7930 and Surlyn 8120 (all products of E.I. DuPont de Nemours & Co.).

The polymer composition of the invention includes, as component B, a metal oxide capable of neutralizing acid groups in component A and/or component D.

Component B is a metal oxide which, as noted above, differs from commonly used metal oxides. In the present invention, use is made of a metal oxide which is produced by plasma synthesis, laser synthesis or flame synthesis, and which has an average particle size of 200 nm or less, and preferably 100 nm or less. That is, in chemical vapor phase deposition processes, metal oxides in the form of fine particles having excellent flow properties and dispersibility can be obtained by a high-temperature process which, in contrast with the heating temperature of 1500° C. or below employed in the electric furnace process used to date, relies on a heating temperature in plasma synthesis, laser synthesis or flame synthesis of several thousands of degrees Centigrade. The resulting metal oxide has an improved dispersibility, yet maintains a higher activity than metal oxide obtained by the electric furnace process. As a result, the neutralization of acid groups in the polymer is promoted, enabling a material of a higher resilience to be obtained.

Illustrative, non-limiting examples of the above metal oxide include zinc oxide, magnesium oxide, calcium oxide, titanium oxide, aluminum oxide, silicon oxide, selenium oxide, yttrium oxide, tin oxide, copper oxide, bismuth oxide, cobalt oxide, iron oxide, manganese oxide and holmium oxide. The use of zinc oxide is effective in the present invention, and thus preferred.

The plasma synthesis process may be selected from among arc plasma synthesis, plasma jet synthesis and high-frequency induction heating plasma synthesis. From the standpoint of dispersibility, it is especially preferable to employ arc plasma synthesis.

A specific example of the above metal oxide that may be preferably used is the very fine zinc oxide having an average primary particle size of 0.03 μm obtained by arc plasma synthesis which is available from C.I. Kasei, Ltd. under the trade name NanoTek (ZnO).

The polymer composition may further include, per 100 parts by weight of component A and/or component D, (C) from 5 to 80 parts by weight of a fatty acid having a molecular weight of at least 280 or a derivative thereof. Component C improves the flow properties of the heated mixture. Compared with the thermoplastic resin serving as component A, component C has a very low molecular weight and helps to greatly increase the melt viscosity of the mixture. Because the fatty acid (or derivative thereof) has a molecular weight of 280 or more and includes a high content of acid groups (or derivatives thereof), the loss of resilience due to addition thereof is small.

The fatty acid or fatty acid derivative of component C may be an unsaturated fatty acid (or derivative thereof) containing a double bond or triple bond on the alkyl moiety, or it may be a saturated fatty acid (or derivative thereof) in which the bonds on the alkyl moiety are all single bonds. It is recommended that the number of carbons on the molecule be generally at least 18, but not more than 80, and preferably not more than 40. Too few carbons may make it impossible to improve the heat resistance, which is an object of the invention, and may also make the acid group content so high as to diminish the flow-improving effect due to interactions with acid groups present in the base resin. On the other hand, too many carbons increases the molecular weight, as a result of which the flow-improving effect may diminish.

Specific examples of the fatty acid of component C include stearic acid, 12-hydroxystearic acid, behenic acid, oleic acid, linoleic acid, linolenic acid, arachidic acid and lignoceric acid. Of these, stearic acid, arachidic acid, behenic acid and lignoceric acid are preferred.

The foregoing fatty acid derivative is a compound in which the proton on the acid group of the fatty acid has been replaced. Such fatty aid derivatives are exemplified by metallic soaps in which the proton on the acid group of the fatty acid has been replaced with a metal ion. Examples of the metal ion include $Li^{+}$, $Ca^{++}$, $Mg^{++}$, $Zn^{++}$, $Mn^{++}$, $Al^{+++}$, $Ni^{++}$, $Fe^{++}$, $Fe^{+++}$, $Cu^{++}$, $Sn^{++}$, $Pb^{++}$ and $Co^{++}$. Of these, $Ca^{++}$, $Mg^{++}$ and $Zn^{++}$ are especially preferred.

Specific examples of fatty acid derivatives that may be used as component C include magnesium stearate, calcium stearate, zinc stearate, magnesium 12-hydroxystearate, calcium 12-hydroxystearate, zinc 12-hydroxystearate, magnesium arachidate, calcium arachidate, zinc arachidate, magnesium behenate, calcium behenate, zinc behenate, magnesium lignocerate, calcium lignocerate and zinc lignocerate. Of these, magnesium stearate, calcium stearate, zinc stearate, magnesium arachidate, calcium arachidate, zinc arachidate, magnesium behenate, calcium behenate, zinc behenate, magnesium lignocerate, calcium lignocerate and zinc lignocerate are preferred.

The inventive polymer composition prepared as described above from components A and/or D, component B, and optionally component C, can be provided with improved thermal stability, moldability and resilience. To achieve these ends, the components must be formulated in certain proportions. Specifically, it is essential to include, per 100 parts by weight of component A (referred to below as the "base resin"), at least 5 parts by weight, but not more than 80 parts by weight, preferably not more than 40 parts by weight, and more preferably not more than 20 parts by weight, of component C; and at least 0.1 part by weight but not more than 10 parts by weight, and preferably not more than 5 parts by weight, of component B. Too little component C will lower the melt viscosity, resulting in a poor processability, whereas too much will lower the durability. Too little component B will fail to improve thermal stability and resilience, whereas too much will instead lower the resilience of the composition due to the presence of excess metal oxide.

The above-described polymer composition may be used directly as is, or other materials may be suitably included in the composition. In either case, it is recommended that the polymer composition have a melt index, as measured according to JIS-K6760 at a temperature of 190° C. and under a load of 21 N (2.16 kgf), of at least 1.0 dg/min, preferably at least 1.5 dg/min, and more preferably at least 2.0 dg/min. It is recommended that the upper limit be preferably 20 dg/min or less, and more preferably 15 dg/min or less. If the polymer composition has a low melt index, the result will be a marked decline in processability.

The polymer composition of the invention is obtained by heating and mixing the above-described component A and/or component D with components B and C, and has an optimized melt index. It is recommended that preferably at least 50 mol %, more preferably at least 70 mol %, and even more preferably at least 90 mol %, of the acid groups in the heated mixture be neutralized. A high degree of neutralization makes it possible to more reliably suppress the exchange reactions that are a problem when only the above-described base resin and fatty acid (or a derivative thereof) are used, thus preventing the formation of fatty acids. As a result, there can be obtained a material which has a greatly increased thermal stability and a good moldability, and which moreover has a much improved resilience compared with prior-art ionomer resins.

As already noted, to obtain the polymer composition of the invention, it suffices to use the above polymer composition as the essential ingredients, although various additives may be optionally included as well. For example, when the inventive polymer composition is to be used as a golf ball cover stock, additives such as pigments, dispersants, antioxidants, ultraviolet absorbers and optical stabilizers may be included within the above composition. To improve the feel of the golf ball on impact, the inventive polymer composition may also include, in addition to the above essential ingredients, various non-ionomeric thermoplastic elastomers. Illustrative examples of such non-ionomeric thermoplastic elastomers include olefin elastomers, styrene elastomers, ester elastomers and urethane elastomers. The use of olefin elastomers and styrene elastomers is especially preferred.

The method of preparing the above polymer composition is not subject to any particular limitation. For example, to obtain the above polymer composition, mixture may be carried out under heating at a temperature of between 150 and 250° C. using as the mixing apparatus an internal mixer such as a kneading-type twin-screw extruder, a Banbury mixer or a kneader. The manner in which the various additives other than the essential ingredients are incorporated into the polymer composition, while not subject to any particular limitation, is exemplified by a method in which the additives are blended together with the essential ingredients and at the same time mixed under heating, and a method in which the essential ingredients are first mixed together under heating, following which the optional additives are added and further mixing under heating is carried out.

The golf ball of the invention is a golf ball formed using the above polymer composition. The layer formed with the polymer composition may make up part or all of the golf ball. The golf ball of the invention may be a thread-wound golf ball (including one in which the cover is composed of a single layer or has a multilayer structure of two or more layers), a one-piece golf ball, a two-piece golf ball, a three-piece golf ball, or a multi-piece golf ball having a cover of three or more layers.

Accordingly, to obtain the golf ball of the invention, the above-described polymer composition may be prepared variously as a one-piece ball material, a solid center for a thread-wound golf ball, or a solid core material or cover material for a solid golf ball (in cases where the core or cover has two or more layers, at least one of the constituent layers), then used in accordance with a known method to produce the golf ball.

If the golf ball of the invention is one in which the cover is made of the above-described polymer composition, the core may be either a thread-wound core or a solid core and may be manufactured according to a conventional method.

In such cases, although the type of core is not subject to any particular limitation, the core is preferably made of a material obtained by molding under heat a rubber composition which includes the following components (a) to (c):

(a) a base rubber containing polybutadiene having a stress relaxation time ($T_{80}$), as defined below, of 3.5 or less, (b) an unsaturated carboxylic acid and/or a metal salt thereof, and (c) an organic peroxide.

In this way, the resilience of the core material is enhanced, enabling the rebound of the golf ball overall to be made very high.

The stress relaxation time ($T_{80}$) is the time in seconds, from the moment when rotor rotation is stopped immediately after measurement of the $ML_{1+4}$ (100° C.) value (the Mooney viscosity measured at 100° C. in accordance with ASTM D-1646-96), that is required for the $ML_{1+4}$ value to decrease 80%.

The term "Mooney viscosity" used herein refers to an industrial indicator of viscosity as measured with a Mooney viscometer, which is a type of rotary plastometer. The unit symbol used is $ML_{1+4}$ (100° C.), where "M" stands for Mooney viscosity, "L" stands for large rotor (L-type), "1+4" stands for a pre-heating time of 1 minute and a rotor rotation time of 4 minutes, and "100° C." indicates that measurement was carried out at a temperature of 100° C.

In the practice of the invention, the polybutadiene in above component (a) includes a polybutadiene having a stress relaxation time ($T_{80}$) of 3.5 or less (which polybutadiene is sometimes abbreviated below as "BR1"). The $T_{80}$ value is preferably 3.0 or less, more preferably 2.8 or less, and even more preferably 2.5 or less. The $T_{80}$ value has a lower limit of preferably 1 or more, and more preferably 1.5 or more. At a $T_{80}$ value of more than 3.5, the objects of the invention cannot be attained. On the other hand, if the $T_{80}$ value is too small, problems with the workability may arise.

The foregoing polybutadiene BR1 has a Mooney viscosity ($ML_{1+4}$ (100° C.)) which, while not subject to any particular limitation, is preferably at least 20 but not more than 80.

It is recommended that the above polybutadiene BR1 have a cis-1,4 bond content of preferably 60%, more preferably at least 80%, even more preferably at least 90%, and most preferably at least 95%, and a 1,2-vinyl bond content of preferably at most 2%, more preferably at most 1.7%, even more preferably at most 1.5%, and most preferably at most 1.3%. At a cis-1,4 bond content or a 1,2-vinyl bond content outside of these ranges, the rebound may decrease.

From the standpoint of rebound, it is preferable for the above polybutadiene BR1 used in the invention to be a polybutadiene synthesized using a rare-earth catalyst.

A known rare-earth catalyst may be used for this purpose. Exemplary rare-earth catalysts include those made up of a combination of a lanthanide series rare-earth compound, an organoaluminum compound, an alumoxane, a halogen-bearing compound, and an optional Lewis base.

Examples of suitable lanthanide series rare-earth compounds include halides, carboxylates, alcoholates, thioalcoholates and amides of atomic number 57 to 71 metals.

Organoaluminum compounds that may be used include those of the formula $AlR^1R^2R^3$ (wherein $R^1$, $R^2$ and $R^3$ are each independently a hydrogen or a hydrocarbon group of 1 to 8 carbons).

Preferred alumoxanes include compounds of the structures shown in formulas (I) and (II) below. The alumoxane association complexes described in *Fine Chemical* 23, No. 9, 5 (1994), *J. Am. Chem. Soc.* 115, 4971 (1993), and *J. Am. Chem. Soc.* 117, 6465 (1995) are also acceptable.

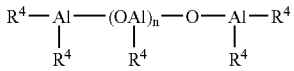

(I)

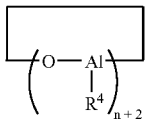

(II)

In the above formulas, $R^4$ is a hydrocarbon group having 1 to 20 carbon atoms, and n is 2 or a larger integer.

Examples of halogen-bearing compounds that may be used include aluminum halides of the formula $AlX_nR_{3-n}$ (wherein X is a halogen; R is a hydrocarbon group of 1 to 20 carbons, such as an alkyl, aryl or aralkyl; and n is 1, 1.5, 2 or 3); strontium halides such as $Me_3SrCl$, $Me_2SrCl_2$, $MeSrHCl_2$ and $MeSrCl_3$; and other metal halides such as silicon tetrachloride, tin tetrachloride and titanium tetrachloride.

The Lewis base can be used to form a complex with the lanthanide series rare-earth compound. Illustrative examples include acetylacetone and ketone alcohols.

In the practice of the invention, the use of a neodymium catalyst in which a neodymium compound serves as the lanthanide series rare-earth compound is particularly advantageous because it enables a polybutadiene rubber having a high cis-1,4 bond content and a low 1,2-vinyl bond content to be obtained at an excellent polymerization activity. Preferred examples of such rare-earth catalysts include those mentioned in JP-A 11-35633.

The polymerization of butadiene in the presence of a rare-earth catalyst may be carried out by bulk polymerization or vapor phase polymerization, either with or without the use of solvent, and at a polymerization temperature in a range of preferably from −30 to +150° C., and more preferably from 10 to 100° C.

To manufacture golf balls of stable quality, it is desirable for the above-described polybutadiene BR1 used in the invention to be a terminal-modified polybutadiene obtained by polymerization using the above-described rare-earth catalyst, followed by the reaction of a terminal modifier with active end groups on the polymer.

A known terminal modifier may be used for this purpose. Illustrative examples include compounds of types (1) to (6) below.

(1) Halogenated organometallic compounds, halogenated metallic compounds and organometallic compounds of the general formulas $R^5_nM'X_{4-n}$, $M'X_4$, $M'X_3$, $R^5_nM'(—R^6—COOR^7)_{4-n}$ or $R^5_nM'(—R^6—COR^7)_{4-n}$ (wherein $R^5$ and $R^6$ are each independently a hydrocarbon group of 1 to 20 carbons; $R^7$ is a hydrocarbon group of 1 to 20 carbons which may contain pendant carbonyl or ester groups; M' is a tin, silicon, germanium or phosphorus atom; X is a halogen atom; and n is an integer from 0 to 3);

(2) heterocumulene compounds having on the molecule a Y═C═Z linkage (wherein Y is a carbon, oxygen, nitrogen or sulfur atom; and Z is an oxygen, nitrogen or sulfur atom);

(3) three-membered heterocyclic compounds containing on the molecule the following bonds

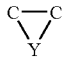

(wherein Y is an oxygen, nitrogen or sulfur atom);

(4) halogenated isocyano compounds;

(5) carboxylic acids, acid halides, ester compounds, carbonate compounds and acid anhydrides of the formula $R^8—(COOH)_m$, $R^9(COX)_m$, $R^{10}—(COO—R^{11})$, $R^{12}—OCOO—R^{13}$, $R^{14}—(COOCO—R^{15})_m$ or

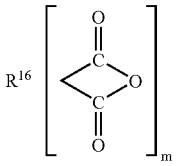

(wherein $R^8$ to $R^{16}$ are each independently a hydrocarbon group of 1 to 50 carbons, X is a halogen atom, and m is an integer from 1 to 5); and (6) carboxylic acid metal salts of the formula $R^{17}_1M''(OCOR^{18})_{4-1}$, $R^{19}_1M''(OCO—R^{20}—COOR^{21})_{4-1}$ or

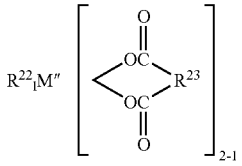

(wherein $R^{17}$ to $R^{23}$ are each independently a hydrocarbon group of 1 to 20 carbons, M" is a tin, silicon or germanium atom, and the letter 1 is an integer from 0 to 3).

Specific examples of the above terminal modifiers (1) to (6) and methods for their reaction are described in, for example, JP-A 11-35633 and JP-A 7-268132.

In the practice of the invention, the above-described polybutadiene BR1 is included within the base rubber and accounts for preferably at least 40 wt %, more preferably at least 50 wt %, even more preferably at least 60 wt %, and even up to 100 wt %, of the base rubber. If this proportion is too low, the rebound may decrease.

No particular limitation is imposed on rubber compounds other than BR1 which may be included in the base rubber. For example, polybutadiene rubbers having a stress relaxation time $T_{80}$ of more than 3.5 may be included, as can also other rubber compounds such as styrene-butadiene rubbers (SBR), natural rubbers, polyisoprene rubbers and ethylene-propylene-diene rubbers (EPDM). These may be used individually or as combinations of two or more thereof.

The Mooney viscosity of such additional rubbers included in the base rubber, while not subject to any particular limitation, is preferably at least 20 but preferably not more than 80.

Rubbers synthesized with a group VIII catalyst may be used as such additional rubbers included in the base rubber. Exemplary group VIII catalysts include the following nickel catalysts and cobalt catalysts.

Examples of suitable nickel catalysts include single-component systems such as nickel-kieselguhr, binary systems such as Raney nickel/titanium tetrachloride, and ternary systems such as nickel compound/organometallic compound/boron trifluoride etherate. Exemplary nickel compounds include reduced nickel on a carrier, Raney nickel, nickel oxide, nickel carboxylate and organonickel complex salts. Exemplary organometallic compounds include trialkylaluminum compounds such as triethylaluminum, tri-n-propylaluminum, triisobutylaluminum and tri-n-hexylaluminum; alkyllithium compounds such as n-butyllithium, sec-butyllithium, tert-butyllithium and 1,4-dilithiumbutane; and dialkylzinc compounds such as diethylzinc and dibutylzinc.

Examples of suitable cobalt catalysts include cobalt and cobalt compounds such as Raney cobalt, cobalt chloride, cobalt bromide, cobalt iodide, cobalt oxide, cobalt sulfate, cobalt carbonate, cobalt phosphate, cobalt phthalate, cobalt carbonyl, cobalt acetylacetonate, cobalt diethyldithiocarbamate, cobalt anilinium nitrite and cobalt dinitrosyl chloride. It is particularly advantageous to use these compounds in combination with, for example, a dialkylaluminum monochloride such as diethylaluminum monochloride or diisobutylaluminum monochloride; a trialkylaluminum such as triethylaluminum, tri-n-propylaluminum, triisobutylaluminum or tri-n-hexylaluminum; an alkylaluminum sesquichloride such as ethylaluminum sesquichloride; or aluminum chloride.

Polymerization using the above group VIII catalysts, and particularly a nickel or cobalt catalyst, can be carried out by a process in which, typically, the catalyst is continuously charged into a reactor together with a solvent and butadiene monomer, and the reaction conditions are suitably selected, such as a reaction temperature in a range of 5 to 60° C. and a reaction pressure in a range of atmospheric pressure to 70 plus atmospheres, so as to yield a product having the above-indicated Mooney viscosity.

Above component (b) may be an unsaturated carboxylic acid, specific examples of which include acrylic acid, methacrylic acid, maleic acid and fumaric acid. Acrylic acid and methacrylic acid are especially preferred. Alternatively, component (b) may be the metal salt of an unsaturated carboxylic acid, examples of which include the zinc and magnesium salts of unsaturated fatty acids such as zinc dimethacrylate and zinc diacrylate. The use of zinc diacrylate is especially preferred.

It is recommended that the content of above component (b) per 100 parts by weight of the base rubber be preferably at least 10 parts by weight, and more preferably at least 15 parts by weight, but preferably not more than 60 parts by weight, more preferably not more than 50 parts by weight, even more preferably not more than 45 parts by weight, and most preferably not more than 40 parts by weight. Too much component (b) will make the material molded under heat from the rubber composition too hard, giving the golf ball an unpleasant feel on impact. On the other hand, too little will result in a lower rebound.

Above component (c) may be a commercially available product, suitable examples of which include Percumyl D (produced by NOF Corporation), Perhexa C (NOF Corporation) and Luperco 231XL (Atochem Co.). If necessary, a combination of two or more different organic peroxides may be used.

It is recommended that the amount of component (c) per 100 parts by weight of the base rubber be preferably at least 0.1 part by weight, and more preferably at least 0.3 part by weight, but preferably not more than 5 parts by weight, more preferably not more than 4 parts by weight, even more preferably not more than 3 parts by weight, and most preferably not more than 2 parts by weight. Too much or too little component (c) may make it impossible to obtain a suitable hardness distribution, resulting in a poor feel on impact, durability and rebound.

To further improve rebound, it is desirable for the rubber composition in the invention to include also the following component (d):

(d) an organosulfur compound.

Examples of such organosulfur compounds include thiophenols, thionaphthols, halogenated thiophenols, and metal salts thereof. Specific examples include the zinc salts of pentachlorothiophenol, pentafluorothiophenol, pentabromothiophenol and p-chlorothiophenol; and diphenylpolysulfides, dibenzylpolysulfides, dibenzoylpolysulfides, dibenzothiazoylpolysulfides and dithiobenzoylpolysulfides having 2 to 4 sulfurs. These may be used singly or as combinations of two or more thereof. Diphenyldisulfide and/or the zinc salt of pentachlorothiophenol are especially preferred.

It is recommended that the amount of component (d) included per 100 parts by weight of the base rubber be preferably at least 0.1 part by weight, more preferably at least 0.2 part by weight, and even more preferably at least 0.5 part by weight, but preferably not more than 5 parts by weight, more preferably not more than 4 parts by weight, and even more preferably not more than 3 parts by weight. Too much organosulfur compound may make the material molded under heat from the rubber composition too soft, whereas too little may make an improved rebound difficult to achieve.

The rubber composition in the invention may additionally include such additives as inorganic fillers and antioxidants. Illustrative examples of suitable inorganic fillers include zinc oxide, barium sulfate and calcium carbonate. The amount included per 100 parts by weight of the base rubber is preferably at least 5 parts by weight, more preferably at least 7 parts by weight, even more preferably at least 10 parts by weight, and most preferably at least 13 parts by weight, but preferably not more than 80 parts by weight, more preferably not more than 50 parts by weight, even more preferably not more than 45 parts by weight, and most preferably not more than 40 parts by weight. Too much or too little inorganic filler may make it impossible to obtain a proper golf ball weight and a suitable rebound.

To increase the rebound, it is desirable for the inorganic filler to include zinc oxide in an amount of at least 50 wt %, preferably at least 75 wt %, and most preferably 100 wt % (where the zinc oxide accounts for 100% of the inorganic filler).

The zinc oxide has an average particle size (by air permeametry) of preferably at least 0.01 μm, more preferably at least 0.05 μm, and most preferably at least 0.1 μm, but preferably not more than 2 μm, and more preferably not more than 1 μm.

Examples of suitable commercial antioxidants include 2,2'-methylenebis(4-methyl-6-t-butylphenol) (Nocrac NS-6, available from Ouchi Shinko Chemical Industry Co., Ltd.) and 2,2'-methylenebis(4-ethyl-6-t-butylphenol) (Nocrac NS-5, Ouchi Shinko Chemical Industry Co., Ltd.). To achieve a good rebound and durability, it is recommended that the amount of antioxidant included per 100 parts by weight of the base rubber be preferably more than 0 part by weight, more preferably at least 0.05 part by weight, even more preferably at least 0.1 part by weight, and most preferably at least 0.2 part by weight, but preferably not more than 3 parts by weight, more preferably not more than 2 parts by weight, even more preferably not more than 1 part by weight, and most preferably not more than 0.5 part by weight.

The core in the present invention can be obtained by vulcanizing and curing the rubber composition using a method of the same sort as that used on prior-art rubber compositions for golf balls. Vulcanization may be carried out, for example, at a temperature of from 100 to 200° C. for a period of 10 to 40 minutes.

It is recommended that the core (hot-molded material) in the invention have a hardness difference, obtained by subtracting the JIS-C hardness at the center of the hot-molded material from the JIS-C hardness at the surface of the material, of preferably at least 15, more preferably at least 16, even more preferably at least 17, and most preferably at least 18, but preferably not more than 50, and more preferably not more than 40. Setting the hardness within this range is desirable for achieving a golf ball having a soft feel and a good rebound and durability.

It is also recommended that the core (hot-molded material) in the invention have a deflection, when compressed under a final load of 1275 N (130 kgf) from an initial load of 98 N (10 kgf), of preferably at least 2.0 mm, more preferably at least 2.5 mm, and even more preferably at least 2.8 mm, but preferably not more than 6.0 mm, more preferably not more than 5.5 mm, even more preferably not more than 5.0 mm, and most preferably not more than 4.5 mm. Too small a deflection may worsen the feel of the ball on impact and, particularly on long shots such as with a driver in which the ball incurs a large deformation, may subject the ball to an excessive rise in spin, shortening the distance traveled by the ball. On the other hand, a hot-molded material that is too soft may deaden the feel of the golf ball when played and compromise the rebound of the ball, resulting in a shorter distance, and may give the ball a poor durability to cracking with repeated impact.

It is recommended that the core have a diameter of preferably at least 30.0 mm, more preferably at least 32.0 mm, even more preferably at least 35.0 mm, and most preferably at least 37.0 mm, but preferably not more than 41.0 mm, more preferably not more than 40.5 mm, even more preferably not more than 40.0 mm, and most preferably not more than 39.5 mm.

It is recommended that such a solid core in a solid two-piece golf ball have a diameter of preferably at least 37.0 mm, more preferably at least 37.5 mm, even more preferably at least 38.0 mm, and most preferably at least 38.5 mm, but preferably not more than 41.0 mm, more preferably not more than 40.5 mm, and even more preferably not more than 40.0 mm.

It is recommended that such a solid core in a solid three-piece golf ball have a diameter of preferably at least 30.0 mm, more preferably at least 32.0 mm, even more preferably at least 34.0 mm, and most preferably at least 35.0 mm, but preferably not more than 40.0 mm, more preferably not more than 39.5 mm, and even more preferably not more than 39.0 mm.

It is also recommended that the core have a specific gravity of preferably at least 0.9, more preferably at least 1.0, and even more preferably at least 1.1, but preferably not more than 1.4, more preferably not more than 1.3, and even more preferably not more than 1.2.

Production of a thread-wound core for a thread-wound golf ball may be carried out by first creating a liquid or solid center. In the case of a liquid center, a hollow spherical center envelope is typically formed from the above-described rubber composition, for example, after which the envelope is filled with a liquid by a method known to the art. A solid center may be produced by the solid core production method described above. Rubber thread is then wound in a stretched state about the resulting center to form the core.

Use may be made of rubber thread produced by a conventional method in which, for example, a rubber composition prepared by compounding natural rubber or synthetic rubber such as polyisoprene with various additives (e.g., antioxidants, vulcanization accelerators, sulfur) is extruded and vulcanized.

To obtain golf balls according to the invention using the various types of cores described above, use may be made of a method in which a cover is formed of the above-described polymer composition, such as a method in which a single-layer core or a multilayer core of two or more layers that has been prefabricated according to the type of ball to be manufactured is placed in a mold and the polymer composition of the invention is heated, mixed and melted, then injection molded over the core. In this case, the golf ball manufacturing operation may be carried out under conditions which ensure that the material has an excellent thermal stability, flow properties and moldability. The resulting golf ball has a high rebound.

The cover-forming method is not limited to the method described above. For example, use may be made of a method in which first a pair of hemispherical half-cups is molded from the cover material of the invention, following which the half-cups are placed over a core and molded under pressure at 120 to 170° C. for 1 to 5 minutes.

The thickness of the cover formed of the above-described polymer composition as the molding material is not subject to any particular limitation, although the cover may be formed to a thickness of preferably at least 1 mm, and more preferably at least 1.3 mm, but preferably not more than 4 mm, and more preferably not more than 2.3 mm. The cover of the inventive ball is not limited to one layer, and may be formed so as to have a multilayer structure of two or more layers. When the cover has a multilayer structure, the cover material of the invention may be used either at the inner side of the multilayer structure or in the outermost cover layer. In the practice of the invention, when the golf ball has a single-layer cover, the cover material of the invention is used to form the cover. When the golf ball has a cover of two or more layers, the cover material of the invention may be suitably used in an inner cover layer other than the outermost cover layer.

The surface of the outermost cover layer may have a plurality of dimples formed thereon, and the cover may be administered various treatments, such as surface preparation, stamping and painting. In particular, the ease of operation involved in administering such surface treatment to a golf ball cover made of the cover material of the invention can be improved on account of the good moldability of the cover surface.

In golf balls formed in the above-described manner, parameters such as the diameter, weight and hardness of the above-described cover, solid or liquid center, solid core, thread-wound core and one-piece golf ball may be suitably adjusted within ranges where the objects of the invention can be obtained, and are not subject to any particular limitations.

The golf ball of the invention may be a golf ball wherein the above-described polymer composition is used elsewhere than in the above-described cover material. For example, the golf ball may be one in which the polymer composition is used as a one-piece golf ball material or as a core material, and may be manufactured by injection molding.

The golf ball of the invention, which can be manufactured so as to conform with the Rules of Golf for competitive play, may be produced to a ball diameter of not less than 42.67 mm and a weight of not more than 45.93 g.

The present invention provides tonically bonded polymer compositions of excellent resilience which are particularly well-suited for use as golf ball-forming materials, and provides also golf balls of outstanding rebound which are made using such polymer compositions.

EXAMPLES

The following Examples and Comparative Examples are provided by way of illustration and not by way of limitation.

Example 1 and Comparative Examples 1 to 5

Using a core material composed primarily of the polybutadiene shown in Table 1 below, a solid core having a diameter of 38.6 mm, a weight of 35.1 g, and a deflection adjusted to 3.2 mm or 3.3 mm was produced. The deflection was the measured amount of deformation by the core when compressed under a final load of 1,275 N (130 kgf) from an initial load of 98 N (10 kgf).

TABLE 1

| | | Core No. | | | |
|---|---|---|---|---|---|
| | | No. 1 | No. 2 | No. 3 | No. 4 |
| Formulation (pbw) | Polybutadiene EC140 | 100 | | | |
| | Polybutadiene BR51 | | 100 | | |
| | Polybutadiene BR60 | | | 100 | |
| | Polybutadiene BR01 | | | | 100 |
| | Peroxide | 1 | 1 | 1 | 1 |
| | Zinc oxide | 18.2 | 18.2 | 18.2 | 18.2 |
| | Antioxidant | 0.2 | 0.2 | 0.2 | 0.2 |
| | Zinc diacrylate | 32 | 32 | 32 | 32 |
| | Zinc salt of pentachlorothiophenol | 1.1 | 1.1 | 1.1 | 1.1 |
| | Zinc stearate | 5 | 5 | 5 | 5 |
| Properties | Diameter (mm) | 38.6 | 38.6 | 38.6 | 38.6 |
| | Weight (g) | 35.1 | 35.1 | 35.1 | 35.1 |
| | Deflection (mm) | 3.3 | 3.3 | 3.3 | 3.2 |

Details of the above formulation are provided below.

Polybutadiene rubber:

EC140 (trade name), available from Firestone Polymers. Polymerized with a neodymium catalyst. Mooney viscosity, 43; $T_{80}$ value, 2.3.

Polybutadiene Rubber:

BR51 (trade name), available from JSR Corporation. Polymerized with a neodymium catalyst. Mooney viscosity, 39; $T_{80}$ value, 5.0.

Polybutadiene Rubber:

BR60 (trade name), available from Polimeri Srl. Polymerized with a neodymium catalyst. Mooney viscosity, 57; $T_{80}$ value, 4.6.

Polybutadiene Rubber:

BR01 (trade name), available from JSR Corporation. Polymerized with a nickel catalyst. Mooney viscosity, 48; $T_{80}$ value, 8.4.

Peroxide: Dicumyl peroxide, available from NOF Corporation under the trade name Percumyl D.

Zinc oxide: Available from Sakai Chemical Industry Co., Ltd. Average particle size, 0.6 μm (air permeametry). Specific surface area, 3.5 $m^2$ (BET method).

Antioxidant: Nocrac NS-6 (trade name), available from Ouchi Shinko Chemical Industry Co., Ltd.

Zinc diacrylate: Available from Nippon Shokubai Co., Ltd.

Zinc stearate: Available from NOF Corporation under the trade name Zinc Stearate G.

Next, the cover materials X, Y and Z of the compositions shown in Table 2 were mixed at 200° C. in a kneading-type twin-screw extruder, giving a pelletized cover stock, following which the cover stock was injected into a mold in which the above-described solid core had been placed, thereby manufacturing a solid two-piece golf ball with a diameter of 42.8 mm and having a 2.1 mm thick cover.

TABLE 2

| Formulation | X | Y | Z |
|---|---|---|---|
| Nucrel AN4318 | 100 | 100 | 100 |
| Zinc oxide I (arc plasma process) | 1.5 | | |
| Zinc oxide II (electric furnace process) | | 1.5 | |
| Zinc oxide III | | | 1.5 |
| Zinc stearate | 20 | 20 | 20 |
| Titanium dioxide | 2 | 2 | 2 |
| Degree of neutralization (mol %) | 67 | 67 | 67 |

Note:
Numbers for each ingredient in the table indicate parts by weight.

Trade names and materials appearing in the table are explained below.

Nucrel AN4318: An ethylene-methacrylic acid-acrylic acid ester copolymer having an acid content of 8 wt % and an ester content of 17 wt %. Produced by DuPont-Mitsui Polychemicals Co., Ltd.

Zinc oxide I: An ultrafine zinc oxide, available from C.I. Kasei, Ltd. under the trade name NanoTek ZnO, having an average primary particle size of 0.03 μm and obtained by arc plasma synthesis.

Zinc oxide II: An ultrafine zinc oxide, available from Sakai Chemical Industry Co., Ltd. under the trade name Finex-50, having an average primary particle size of 0.02 μm and obtained by the evaporation and oxidation of electrolytic zinc metal.

Zinc oxide III: Grade 3 zinc oxide available from Sakai Chemical Industry Co., Ltd, a general-purpose zinc oxide having an average particle size of 0.6 μm.

Zinc stearate: Available from NOF Corporation under the trade name Zinc Stearate G.

The properties of each cover material and golf ball were evaluated as follows. The results are shown in Tables 2 and 3.

Ball Deflection

The amount of deformation (mm) by the golf ball when compressed under a final load of 1,275 N (130 kgf) from an initial load state of 98 N (10 kgf) was determined.

Initial Velocity

The initial velocity was measured using an initial velocity measuring apparatus of the same type as that of the official golf ball regulating-body—R&A (USGA), and in accordance with R&A (USGA) rules.

Degree of Neutralization

Of the total acid groups (including acid groups in fatty acids (and derivatives thereof)) included in the polymer composition, the molar fraction of acid groups neutralized by metal ions was calculated from the acid content, degree of neutralization and molecular weight of the starting materials.

TABLE 3

| | Example | Comparative Example | | | | |
|---|---|---|---|---|---|---|
| | 1 | 1 | 2 | 3 | 4 | 5 |
| Core No. | No. 1 | No. 1 | No. 1 | No. 2 | No. 3 | No. 4 |
| Cover No. | X | Y | Z | X | X | X |
| Weight (g) | 45.2 | 45.2 | 45.2 | 45.2 | 45.2 | 45.2 |
| Deflection (mm) | 2.93 | 2.99 | 3.21 | 2.93 | 2.93 | 2.89 |
| Initial velocity (m/s) | 77.3 | 76.9 | 76.1 | 76.6 | 76.6 | 76.4 |

The results for the above example of the invention and the comparative examples are summarized below.

EXAMPLE 1 VERSUS COMPARATIVE EXAMPLES 1 AND 2

Golf balls were fabricated by enclosing the same type of core with polymer composition X, Y or Z. Polymer composition X containing zinc oxide produced by plasma synthesis yielded a ball having a more rapid initial velocity than balls obtained using polymer compositions Y and Z which contained zinc oxide produced by other processes. These results demonstrated that the polymer compositions of the invention are materials having a high resilience.

EXAMPLE 1 VERSUS COMPARATIVE EXAMPLES 3 TO 5

Also, the initial velocities of golf balls obtained in Example 1 of the invention and in Comparative Examples 3 to 5 with varying ball components were compared. When the polymer composition of the invention was used as one ball component, and the type of polybutadiene used in the core as another ball component was varied, the ball in which core No. 1 containing polybutadiene having a $T_{80}$ value of 3.5 or less was used had a higher initial velocity than the balls in which cores No. 2 to 4, which did not contain polybutadiene having a $T_{80}$ value of 3.5 or less, were used.

The above results demonstrate that when the polymer composition of the invention is used as the cover material in combination with a polybutadiene having a $T_{80}$ value of 3.5 or less as the core material, golf balls having an even higher rebound performance can be obtained.

The invention claimed is:

1. A polymer composition comprising:

(A) 100 parts by weight of an olefin-unsaturated carboxylic acid random copolymer and/or an olefin-unsaturated carboxylic acid-unsaturated carboxylic acid ester random copolymer, and (B) from 0.1 to 10 parts by weight of a metal oxide capable of neutralizing acid groups in component A;

wherein the metal oxide is produced by plasma synthesis, laser synthesis or flame synthesis and has an average particle diameter of at most 200 nm.

2. A polymer composition comprising:

(D) 100 parts by weight of a metal ion neutralization product of an olefin-unsaturated carboxylic acid random copolymer and/or a metal ion neutralization product of an olefin-unsaturated carboxylic acid-unsaturated carboxylic acid ester random copolymer, and (B) from 0.1 to 10 parts by weight of a metal oxide capable of neutralizing acid groups in component D;

wherein the metal oxide is produced by plasma synthesis, laser synthesis or flame synthesis and has an average particle diameter of at most 200 nm.

3. A polymer composition comprising:

100 parts by weight of, in admixture, (A) an olefin unsaturated carboxylic acid random copolymer and/or an olefin-unsaturated carboxylic acid-unsaturated carboxylic acid ester random copolymer and (D) a metal ion neutralization product of an olefin-unsaturated carboxylic acid random copolymer and/or a metal ion neutralization product of an olefin-unsaturated carboxylic acid-unsaturated carboxylic acid ester random copolymer, and (B) from 0.1 to 10 parts by weight of a metal oxide capable of neutralizing acid groups in components A and D;

wherein the metal oxide is produced by plasma synthesis, laser synthesis or flame synthesis and has an average particle size of at most 200 nm.

4. The polymer composition according to any one of claims 1 to 3 which further comprises, per 100 parts by weight of component A and/or component D, (C) from 5 to 80 parts by weight of a fatty acid having a molecular weight of at least 280 or a derivative thereof.

5. The polymer composition of any one of claims 1 to 3, wherein the composition has a melt index of at least 1.0 dg/min.

6. The polymer composition of any one of claims 1 to 3, wherein the metal oxide of component B is selected from the group consisting of zinc oxide, magnesium oxide, calcium oxide, titanium oxide, aluminum oxide, silicon oxide, selenium oxide, yttrium oxide, tin oxide, copper oxide, bismuth oxide, cobalt oxide, iron oxide, manganese oxide and holmium oxide.

7. The polymer composition of any one of claims 1 to 3, wherein the metal oxide of component B has an average particle size of at most 100 nm.

8. The polymer composition of any one of claims 1 to 3, wherein the metal oxide of component B is produced by a plasma synthesis process selected from the group consisting of arc plasma synthesis, plasma jet synthesis and high frequency induction heating plasma synthesis.

9. The polymer composition of claim 8, wherein the plasma synthesis process is arc plasma synthesis.

10. The polymer composition of any one of claims 1 to 3, wherein the degree of neutralization is at least 50 mol %.

11. A golf ball comprising a core and a cover of one or more layer, wherein the core or at least one layer of the cover is made of the polymer composition of any one of claims 1 to 3.

12. A golf ball comprising a core and a cover of one or more layer, wherein the core is made of a material obtained by molding under heat a rubber composition comprising (a) a base rubber containing polybutadiene having a stress relaxation time ($T_{80}$), defined as the time in seconds from the moment when rotation is stopped immediately after measurement of the $ML_{1+4}$ (100° C.) value (the Mooney viscosity measured at 100° C. in accordance with ASTM D-1646-96) that is required for the $ML_{1+4}$ value to decrease 80%, of 3.5 or less, (b) an unsaturated carboxylic acid and/or a metal salt thereof, and (c) an organic peroxide; and at least one layer of the cover is made of a polymer composition comprising:

(A) 100 parts by weight of an olefin-unsaturated carboxylic acid random copolymer and/or an olefin-unsaturated carboxylic acid-unsaturated carboxylic acid ester random copolymer, and (B) from 0.1 to 10 parts by weight of a metal oxide capable of neutralizing acid groups in component A;

wherein the metal oxide is produced by plasma synthesis, laser synthesis or flame synthesis and has an average particle diameter of at most 200 nm.

13. A golf ball comprising a core and a cover of one or more layer, wherein the core is made of a material obtained by molding under heat a rubber composition comprising (a) a base rubber containing polybutadiene having a stress relaxation time ($T_{80}$), defined as the time in seconds from the moment when rotation is stopped immediately after measurement of the $ML_{1+4}$ 100° C. value (the Mooney viscosity measured at 100° C. in accordance with ASTM D-1646-96) that is required for the $ML_{1+4}$ value to decrease 80%, of 3.5 or less, (b) an unsaturated carboxylic acid and/or a metal salt thereof, and (c) an organic peroxide; and at least one layer of the cover is made of a polymer composition comprising:

(D) 100 parts by weight of a metal ion neutralization product of an olefin-unsaturated carboxylic acid random copolymer and/or a metal ion neutralization product of an olefin-unsaturated carboxylic acid-unsaturated carboxylic acid ester random copolymer, and (B) from 0.1 to 10 parts by weight of a metal oxide capable of neutralizing acid groups in component D;

wherein the metal oxide is produced by plasma synthesis, laser synthesis or flame synthesis and has an average particle diameter of at most 200 nm.

14. A golf ball comprising a core and a cover of one or more layer, wherein the core is made of a material obtained by molding under heat a rubber composition comprising (a) a base rubber containing polybutadiene having a stress relaxation time ($T_{80}$), defined as the time in seconds from the moment when rotation is stopped immediately after measurement of the $ML_{1+4}$ 100° C. value (the Mooney viscosity measured at 100° C. in accordance with ASTM D-1646-96) that is required for the $ML_{1+4}$ value to decrease 80%, of 3.5 or less, (b) an unsaturated carboxylic acid and/or a metal salt thereof, and (c) an organic peroxide; and at least one layer of the cover is made of a polymer composition comprising:

100 parts by weight of, in admixture, (A) an olefin unsaturated carboxylic acid random copolymer and/or an olefin-unsaturated carboxylic acid-unsaturated carboxylic acid ester random copolymer and (D) a metal ion neutralization product of an olefin-unsaturated carboxylic acid random copolymer and/or a metal ion neutralization product of an olefin-unsaturated carboxylic acid-unsaturated carboxylic acid ester random copolymer, and (B) from 0.1 to 10 parts by weight of a metal oxide capable of neutralizing acid groups in components A and D;

wherein the metal oxide is produced by plasma synthesis, laser synthesis or flame synthesis and has an average particle size of at most 200 nm.

* * * * *